United States Patent [19]

Boehme et al.

[11] Patent Number: 4,820,955

[45] Date of Patent: Apr. 11, 1989

[54] TRAVELING WAVE TUBE COMPRISING PERIODIC PERMANENT MAGNETIC FOCUSING SYSTEM WITH GLASS/EPOXY RETAINING MEANS

[75] Inventors: Gerit Boehme, Oberaudorf; Hermann Turnwald, Obersuessbach, both of Fed. Rep. of Germany

[73] Assignee: Siemens Aktiengesellschaft, Berlin and Munich, Fed. Rep. of Germany

[21] Appl. No.: 125,476

[22] Filed: Nov. 25, 1987

[30] Foreign Application Priority Data

Nov. 26, 1986 [DE] Fed. Rep. of Germany ..... 364033

[51] Int. Cl.[4] ..... H01J 29/86; H01J 5/26

[52] U.S. Cl. ..... 315/3.5; 315/5.35; 313/156

[58] Field of Search ..... 315/3.5, 3.6, 5.34, 315/5.35, 39.3; 330/4.3, 44; 313/156, 157; 335/210, 303

[56] References Cited

U.S. PATENT DOCUMENTS

| | | | |
|---|---|---|---|
| 3,227,913 | 1/1966 | Disman et al. | 315/3.5 |
| 4,104,559 | 8/1978 | Hobbs | 315/39.51 |
| 4,283,656 | 8/1981 | Goto et al. | 315/3.6 X |
| 4,539,512 | 9/1985 | Heynisch et al. | 315/5.35 |
| 4,712,293 | 12/1987 | Manoly | 29/600 |

FOREIGN PATENT DOCUMENTS

| | | | |
|---|---|---|---|
| 4541060 | 10/1969 | Fed. Rep. of Germany | 315/3.5 |
| 3216250C2 | 4/1985 | Fed. Rep. of Germany | 315/3.5 |

OTHER PUBLICATIONS

2213 Frequenz, vol. 35 (1981) Jun., No. 6, Berlin, Germany, "Application of Carbon Fibre Epoxy Technology to RF-Components of Satellite Payloads", pp. 155-162.

*Primary Examiner*—David K. Moore
*Assistant Examiner*—Mark R. Powell
*Attorney, Agent, or Firm*—Hill, Van Santen, Steadman & Simpson

[57] ABSTRACT

A traveling wave tube has a cylindrical vacuum envelope surrounding a delay line. The vacuum envelope is tightly surrounded by a permanent magnet system of ring-shaped pole discs and of magnetic rings respectively arranged between the pole discs and oppositely polarized in alternating fashion in an axial direction. The permanent magnet system is inserted into an outer envelope in form-fit fashion. An attitude and position retention for the focusing elements which is resistant to temperature shock is provided in the traveling wave tube. For this purpose the permanent magnet system is glued at its outside generated surface and the glue is formed of a mixture of an epoxy resin having adhesive properties and of glass fibers provided therein in an undirected attitude. This traveling wave tube is useful given extreme temperature fluctuations, such as in a range from −60° C. through +95° C.

6 Claims, 1 Drawing Sheet

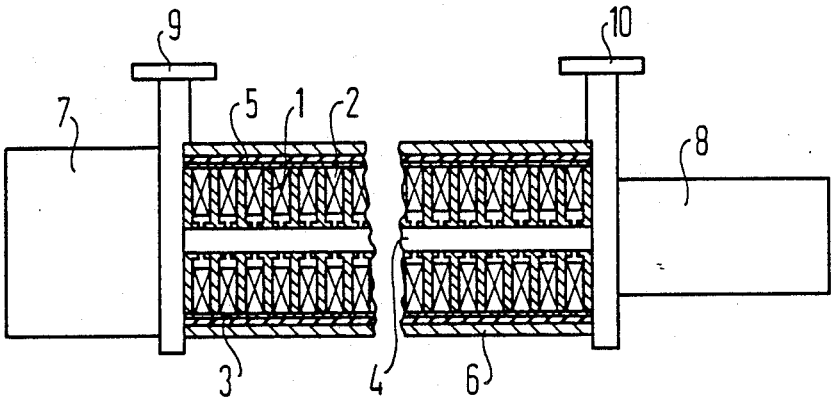
9
10
7
5
1
2
8
3
4
6

TRAVELING WAVE TUBE COMPRISING PERIODIC PERMANENT MAGNETIC FOCUSING SYSTEM WITH GLASS/EPOXY RETAINING MEANS

BACKGROUND OF THE INVENTION

The invention concerns a traveling wave tube wherein a cylindrical vacuum envelope surrounds a delay line. The vacuum envelope is tightly surrounded by a permanent magnet system formed of annular pole discs and respective magnetic rings arranged between the pole discs which are oppositely polarized in alternating fashion along an axial direction of the tube. The permanent magnet system is inserted into an outside envelope in form-fit fashion.

A traveling wave tube having such a permanent magnet system is disclosed in German Pat. No. 32 16 250, incorporated herein by reference.

This system is also referred to as a PPM focusing system (Periodic Permanent Magnetic focusing system). Previously known PPM systems used pole discs which are centered on the vacuum envelope of the traveling wave tube with a certain play. At the same time, both the ring magnets as well as the pole discs had to observe extreme parallelism. This system presents difficulties in view of the balancing function. In a PPM focusing system for traveling wave tubes, there is the problem of generating a sequence of alternating magnetic fields which can be easily balanced on the tube. Nonetheless, a stable behavior of the overall mechanical structure must be guaranteed, even given a greater thermal stress, that is both a continuous stress as well as an alternating stress. The previous plug-in technology also exhibits problems involving the fitting tolerances. In order to create a stable PPM focusing system, German Pat. No. 32 16 250 discloses that the pole discs can be soldered to corresponding spacing rings of nonomagnetic material to form a rigid, stable unit.

It is also known to glue together a PPM focusing system. The problem arises, however, that the tube focusing can fail due to an undefined gap formation between magnets and pole shoes produced by a sudden temperature change on the order of 150° C. Such a large temperature modification in traveling wave tubes is required, for example, for use in cosmic space conditions, and is practically unavoidable, or can only be avoided at great technological expense. The traveling wave tube may become unusable due to the temperature shock. The cause is a spontaneous formation of radial cracks in the connection or gluing of the focusing system at the locations of lowest strength produced due to excessively great differences in the thermal expansion of different materials. This problem therefore particularly occurs because the magnet system is formed of a plurality of magnets and pole shoes, for example 45 magnets and 46 pole shoes, which are movably mounted on the delay line.

SUMMARY OF THE INVENTION

An object of the invention is to avoid these disadvantages and to create an attitude and position retention for the focusing elements of a traveling wave tube which is insensitive to temperature shock, and which also operates reliably at extreme temperature fluctuations, for example, in a range from about −60° C. through +95° C.

In a traveling wave tube of the type initially cited, this object is achieved by providing glue at an outside generated surface of the permanent magnet system and wherein the glue is formed of a mixture of an epoxy resin having adhesive properties and glass fibers provided therein in an undirected attitude.

Advantages achieved with the invention are that the previously known fastening of the focusing elements is replaced by a gluing which is composed of a mixture of an epoxy resin with adhesive properties and glass fibers contained therein in undirected attitude, such as fiberglass. This gluing is applied to the periphery of the permanent magnetic system. Specific epoxy resins having adhesive properties are available, for example, under the trade name Araldit. The fiberglass component added to the epoxy resin having adhesive properties preferably amounts to about 15% by weight, and the cut length of the fiberglass fibers prepared for wetting with epoxy resin amounts to approximately 3.5 mm.

The thermal expansion of the mixture lies significantly closer to the expansion of the focusing system. Given selection of the epoxy resin (Araldit), it is preferable to select such a composition whose elasticity is as great as possible at low temperatures.

The non-directed attitude of the fiberglass fibers contained in the gluing applied to the permanent magnet system results in such a strength that forces that act on the focusing system due to thermal stresses are uniformly transmitted onto all elements of the focusing system by the elasticity without having a spontaneous crack formation occurring. The fiberglass fibers not lying strictly in a defined direction are the cause of these favorable elastic properties. Fiberglass fibers aligned with definition, by contrast, can lead to the formation of radial cracks.

It is advantageous for further reducing the thermal shock to clad the fiberglass-epoxy resin (Araldit) mixture with a thermally insulating material, for example silicone rubber, after curing. The effective temperature range can be further expanded with this technique.

BRIEF DESCRIPTION OF THE DRAWING

The drawing FIGURE schematically illustrates in partial section a traveling wave tube of the invention.

DESCRIPTION OF THE PREFERRED EMBODIMENTS

The traveling wave tube is essentially formed of a cylindrical vacuum envelope 4 surrounding a delay line. Vacuum envelope 4 is tightly surrounded by a permanent magnet system. The permanent magnet system is formed of annular pole discs 1, and of magnetic rings 2 respectively arranged between these discs 1 and which are oppositely polarized in alternating fashion along the axial direction. The permanent magnet system is inserted into a metallic, outside envelope 6. For example, the outside envelope is formed of aluminum. The vacuum envelope 4 as well as the delay line situated therein are formed, for example, of copper. In this exemplary embodiment, the pole discs 1 have projections at both sides in the region of their transition onto the vacuum envelope 4, so that they are T-shaped in cross-section. The permanent magnet system 1, 2 is glued at its outside generated surface. The gluing 3 applied to the outside generated surface (periphery) in the form of a layer is formed of a mixture of an epoxy resin having adhesive properties (Araldit) and of glass fibers provided therein in unaligned attitude (preferably fiberglass fibers). The gluing 3 in this exemplary embodiment is surrounded by a layer 5 of thermally insulating material as a heat insulating layer. The overall system is terminated at its one side by a RF in-coupling wave guide 9 and an electron gun 7, and is terminated at its other side by a RF out-coupling wave guide 10 and a collector 8.

Although various minor changes and modifications might be suggested by those skilled in the art, it will be apparent that we wish to include within the claims of the patent warranted hereon all such changes and modifications as reasonably come within our contribution to the art.

We claim as our invention:

1. A traveling wave tube, comprising:

a cylindrical vacuum envelope surrounding a delay line;

said vacuum envelope being tightly surrounded by a permanent magnet system formed of annular pole discs and respective magnetic rings arranged between the pole discs which are oppositely polarized in alternating fashion along an axial direction of the tube;

said permanent magnet system being inserted into an outside envelope in form-fit fashion;

the permanent magnet system having a layer of glue at its outside periphery in direct contact with peripheral surfaces of the pole discs and magnetic rings adjacent an inside surface of the outside envelope; and the glue being formed of a mixture of an epoxy resin having adhesive properties and glass fibers provided therein in an undirected attitude.

2. A traveling wave tube according to claim 1 wherein the glass fibers for the glue are prepared for wetting with epoxy resin.

3. A traveling wave tube according to claim 2 wherein a mixing proportion of the fiberglass fibers provided for the glue is about 15 percent by weight.

4. A traveling wave tube according to claim 2 wherein a cut length of the fiberglass fibers is approximately 3.5 mm.

5. A traveling wave tube according to claim 1 wherein the glue is surrounded by a layer of thermally insulating material positioned between the glue and the outside envelope.

6. A traveling wave tube, comprising:

a cylindrical vacuum envelope surrounding a delay line;

said vacuum envelope being surrounded by a permanent magnet system formed of pole discs having magnetic rings therebetween;

said permanent magnet system with the vacuum envelope being located within an outside envelope;

a layer of glue in direct contact with and outwardly of a peripheral surface of the permanent magnet system adjacent an inside surface of the outside envelope and positioned so as to locate and secure the ring magnets in a play-free and parallel fashion; and said layer of glue being formed of a mixture of an epoxy resin having adhesive properties and glass fibers provided in the epoxy resin in an undirected attitude.

* * * * *